US009540761B2

(12) United States Patent
Pan

(10) Patent No.: US 9,540,761 B2
(45) Date of Patent: Jan. 10, 2017

(54) BISERVICE IRON

(75) Inventor: Chienchih Pan, Tainan (TW)

(73) Assignee: Tsann Kuen (Zhangzhou) Enterprise Co., Ltd., Zhangzhou, Fujian (CN)

( * ) Notice: Subject to any disclaimer, the term of this patent is extended or adjusted under 35 U.S.C. 154(b) by 1041 days.

(21) Appl. No.: 13/516,649

(22) PCT Filed: Dec. 6, 2010

(86) PCT No.: PCT/CN2010/079457
§ 371 (c)(1),
(2), (4) Date: Jun. 15, 2012

(87) PCT Pub. No.: WO2011/072579
PCT Pub. Date: Jun. 23, 2011

(65) Prior Publication Data
US 2012/0255943 A1 Oct. 11, 2012

(30) Foreign Application Priority Data
Dec. 17, 2009 (CN) ..... 2009 2 0317781 U

(51) Int. Cl.
*D06F 75/26* (2006.01)
*D06F 75/10* (2006.01)

(52) U.S. Cl.
CPC ..... *D06F 75/265* (2013.01); *D06F 75/10* (2013.01)

(58) Field of Classification Search
CPC ..... D06F 75/265; D06F 75/10
USPC ..... 219/259, 256, 520, 250; 38/88, 91, 96
See application file for complete search history.

(56) References Cited

U.S. PATENT DOCUMENTS 5,619,812 A * 4/1997 Hensel ..... D06F 75/40 219/259
6,393,740 B1 * 5/2002 Rodriquez ..... D06F 75/26 38/77.7
6,463,685 B1 * 10/2002 Tynes ..... D06F 75/18 38/77.8
2004/0070204 A1 * 4/2004 Becker ..... F02M 37/0017 285/305
2005/0028408 A1 * 2/2005 Tobias ..... D06F 75/32 38/75
2009/0015549 A1 * 1/2009 Gelfond ..... G06F 3/0362 345/156

FOREIGN PATENT DOCUMENTS

CN 201317889 Y 9/2009
CN 201317890 Y 9/2009
CN 201588124 U 9/2010

* cited by examiner

*Primary Examiner* — Phuong Nguyen
(74) *Attorney, Agent, or Firm* — Edward E. Sowers; Brannon Sowers & Cracraft PC

(57) ABSTRACT

The present invention of a biservice iron relates to an iron, especially an iron of which the steam brush and the base of the metal soleplate are disassembled. The present invention of a biservice iron includes a steam brush set, a base set and a thermoregulator knob. The thermoregulatory knob includes an external knob rotatably disposed on the housing of the steam brush set and an inner knob rotatably disposed on the housing of the base set. The inner knob is connected to the level lever of the thermoregulator on the housing of the base set. The external knob is inserted.

13 Claims, 14 Drawing Sheets

B - B

BISERVICE IRON

FIELD OF THE INVENTION

The present invention relates to an iron, especially an iron of which the steam brush and the base of the metal soleplate are disassembled.

BACKGROUND OF THE INVENTION

The existing irons are disposed with a metal soleplate, which has a heating pan, in the lower portion of the housing. A thermoregulator is disposed inside the housing to control the power to the heating pan and then change the heat radiation of the metal soleplate; the housing is disposed with thermoregulator knob, which is directly connected to the level lever of thermoregulator to regulate the level of the electricity output of the thermoregulator.

To expand the use mode of the iron, combining a steam brush set and a base set to be a biservice iron.

The steam boiler of electrical heated is disposed inside the housing of the steam brush set. The steam outlet of the steam brush is connected to the outside from the bottom of the housing. The electrical wire is led into the housing from the rear portion and connected to the switch of the steam boiler. Turn on the switch, the steam boiler is energized by the external power, the water inside the steam boiler turns into steam and spurts out from the bottom of the housing. A handle is disposed on the housing of the steam brush set for independently usage of garment ironing.

The heating pan is disposed at the bottom of the housing of the base set. The thermoregulator is disposed inside the housing to control the power to the heating pan and then change the radial of the heating pan. The housing of the base set is disposed without handle, but the housing of the base set is disposed with an accommodation room for the steam brush set and for locking the lower of the steam brush set. The steam brush set is locked to the base set, forming an iron with a handle for ironing.

However, how to realize the thermoregulator knob on the steam brush to disassemble connect to the level lever of the thermoregulator on the base set to regulate the level of the energy output of the thermoregulator is a much vexed problem for the designer. In the disassemble state, the rotation positions of the thermoregulator knob on the steam brush and the level lever of the thermoregulator on the base set are random, making it difficult to make sure that the thermoregulator knob and the level lever of the thermoregulator are rotating synchronously when the steam brush set is locked to the base set. Besides, it's difficult to ensure that the level indicator for the thermoregulator knob can exactly read the present level of the thermoregulator when the thermoregulator knob is randomly connected to the level lever of the thermoregulator.

SUMMARY OF THE INVENTION

The object of the present invention is to provide with a biservice iron, in which the thermoregulator knob and the level lever of the thermoregulator are rotating synchronously when the steam brush set is locked to the base set.

Moreover, the biservice iron is provided that the level indicator for the thermoregulator knob can exactly read the present level of the thermoregulator when the thermoregulator knob is randomly connected to the level lever of the thermoregulator.

The technical proposal of the present invention is: a biservice iron includes a steam brush set, a base set and a thermoregulator knob, the thermoregulator knob includes an external knob which is rotatably disposed on the housing of the steam brush set and an inner knob which is rotatably disposed on the housing of the base set, the inner knob is connected to the level lever of the thermoregulator on the housing of the base set, the external knob and the inner knob are connected to each other in socket way with cylinder of which the cross section is equilateral polygon or star-shaped of equilateral polyhedral angle.

In another preferred embodiment, the cylinder of which the cross section is equilateral polygon or star-shaped of equilateral polyhedral angle between the external knob and the inner knob is conical surface of slightly inward contraction, the free end of the lever between the external knob and the inner knob is disposed with the corresponding cone of inward contraction and equilateral polygon or star-shaped of equilateral polyhedral angle. The external knob is easy to inserted connected to the inner knob, and it can achieve an automatically modification effect with the cone of inward contraction and equilateral polygon or star-shaped of equilateral polyhedral angle in the free end of the lever between the external knob and the inner knob during the inserting.

Moreover, the free end of the lever between the external knob and the inner knob is disposed with at least two grooves. If the position between the external knob and the inner knob is not justified, the free end of the pipe between the above will be slightly opened by the lever, and then it will be modified automatically with the assistant of the elastic restoring force of the free end of the pipe.

Especially, the cylinder, of which the cross section is equilateral polygon or star-shaped of equilateral polyhedral angle, is disposed with at least eight side walls or at least nine angles. This makes it easy for the modification automatically during the inserting of the external knob and the inner knob.

In another preferred embodiment, for the external knob rotatably disposed on the housing of the steam brush set, the top of the external knob is a disc, the central of the lower surface of the disc is extended downward with at least three lock catches of evenly distribution in the peripheral direction, the catch head of every lock catch is turning inside out; the disc in the upper of the external knob is located above the circle pipe shaped assembly portion on the housing of the steam brush set, the lock catches are inserted into the hole of the assembly portion, the catch heads of the lock catches are locked in the inner flange on the top of the assembly portion. The lock catches evenly distribution in the peripheral direction makes the external knob rotatable and easy to be assembled.

In another preferred embodiment, for the inner knob rotatably disposed on the housing of the base set, the central of the inner knob is a circle pipe shaped body, the lower surface of the body is extended downward with at least three lock catches evenly distribution in the peripheral direction, the catch head of every lock catch is turning inside out, the body of the inner knob is located above the circle pipe shaped boss on the upper surface of the housing of the base set, the lock catches are inserted into the hole of the boss, the catch heads of the lock catches are locked in the inner flange on the top of the boss. The lock catches evenly distribution in the peripheral direction makes the inner knob rotatable and easy to be assembled.

For the second object of the present invention, the external knob is made of transparent material, the upper surface of the inner flange at the upper portion of the assembly portion is disposed with level scale of the thermoregulator, the upper surface of the insert portion of the inner knob is disposed with marker for indicating the position of the rotation angle of the level lever of the thermoregulator. The marker on the upper surface of the insert portion of the inner knob is read clearly through the external knob. The marker indicates the correspondence between the rotation angle of the level lever of the thermoregulator and the level scale on the thermoregulator on the housing, that is the present level of the thermoregulator.

The present invention of a biservice iron includes an inserted thermoregulator knob of disassemble, which includes an external knob rotatably disposed on the housing of the steam brush set and an inner knob rotatably disposed on the housing of the base set. The inner knob is connected to the level lever of the thermoregulator on the housing of the base set to regulate the thermoregulator. The external knob and the inner knob are connected to each other in socket way with cylinder of which the cross section is equilateral polygon or star-shaped of equilateral polyhedral angle, making the thermoregulator knob and the level lever of the thermoregulator are rotating synchronously when the steam brush set is locked to the base set. The present invention of a biservice iron is provided to expand the usage mode of the iron, benefit for the consumer with biservice.

DETAILED DESCRIPTION OF THE EMBODIMENTS

Figure 1:
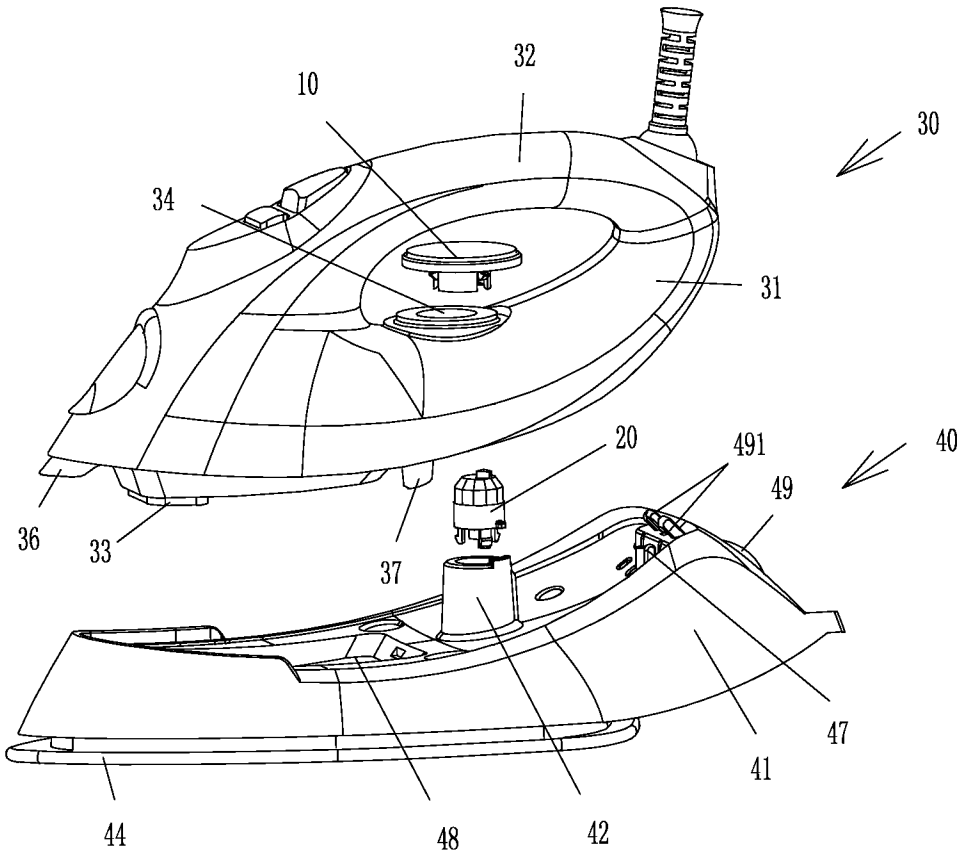
FIG. 1 illustrates the foldable structure of the first embodiment of the biservice iron in the present invention.

The First Embodiment:

The structure of the first embodiment of a biservice iron is figured in the FIG. 1. The biservice iron includes an independent steam brush set 30 and an independent base set 40.

A handle 32 is disposed on the housing 31 of the steam brush 30 for garment steaming. A steam boiler of electric heated is disposed inside the housing 31 of the steam brush set 30. The steam outlet pipe of the steam boiler is connected to outside from the steam outlet portion 33 on the bottom of the housing 31. The electric wire is led into the housing 31 from the rear portion and connected to the switch of the steam boiler. When turning on the switch, the steam boiler is energized by the external power. The water inside the steam boiler turns into steam and spurts out from the steam outlet portion 33 on the bottom of the housing 31. An assembly portion 34 of circuit pipe shaped is disposed below the handle 32 on the housing 31 of the steam brush set 30 for the assembly of the external knob 10. The front portion of the housing 31 of the steam brush set 30 is extended down with an insert head 36. The two sides of the central portion of the housing 31 of the steam brush set 30 are extended down with an insert head 37 each. A catch groove is disposed at the rear of the housing 31 of the steam brush set 30 for holding the overturn catch head 491 of the base set 40. The rear portion on the lower surface of the housing 31 of the steam brush set 30 is disposed with an electrical outlet for energizing the base set 40.

Figure 7:
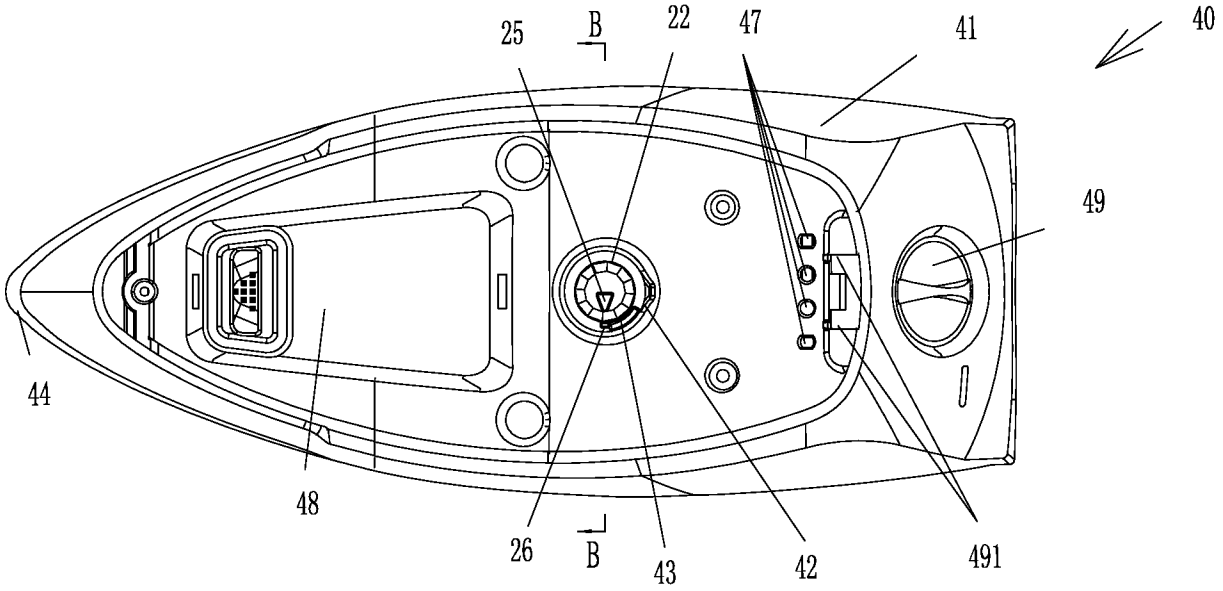
FIG. 7 illustrates the top view of the inner knob installing to the base set of the FIG. 1.
Figure 8:
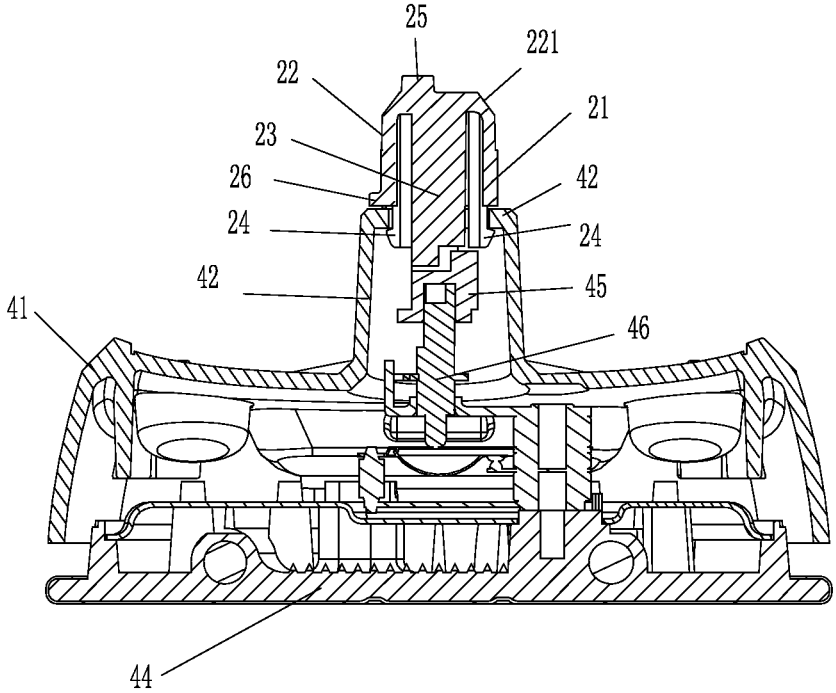
FIG. 8 illustrates the sectional view of the B-B part of the FIG. 7.

Please refer to the FIG. 7 and FIG. 8 with combination with the FIG. 1, the housing 41 of the base set 40 is disposed without a handle. The central of the housing 41 of the base set 40 is disposed with a concave accommodation room 48 to accommodate and catch the lower portion of the steam brush set 30. The central of the accommodation room 48 is disposed with a circular pipe shaped boss 42 extending upward. The upper surface of the boss 42 is disposed with an upward cog 43. The heating pan 44 is disposed on the bottom of the housing 41 of the base set 40. A thermoregulator is disposed inside the housing 41 to energize the heating pan 44 and then change the heat radiation of the heating pan 44. The level lever 46 of the thermoregulator is disposed inside the boss 42, and the thermoregulator base 45 which is also inside the boss 42 is disposed on the upper of the level lever 46, to rotatably connect to the inner knob 20. The rear portion of the accommodation room 48 is disposed with an electrical plug 47, which is cooperated with the electrical outlet of the housing 31 of the steam brush set 30 to receive the power from the steam brush set 30 and then energize the thermoregulator. The rear portion of the accommodation room 48 is disposed with an overturn catch head 491, which is controlled by the lock knob 49 at the rear of the housing 41 of the base set 40.

Put the steam brush set 30 on the accommodation room 48 of the housing 41 of the base set 40, the insert head 36 in the front of the housing 31 of the steam brush set 30 and the insert heads 37 on the two sides of the central of the housing 31 of the steam brush set 30 are separately withstanding the inner wall of the front and the two sides of the central portion of the accommodation room 48. The electrical outlet on the lower surface of the housing 31 of the steam brush set 30 is cooperated with the electrical plug 47 at the rear portion of the accommodation room 48. Rotate the lock knob 49, making the overturn catch head 491 locked into the catch groove at the rear portion of the housing 31 of the steam brush set 30, and then the steam brush set 30 is locked to the base set 40, forming an iron with handle for ironing.

Figure 2:
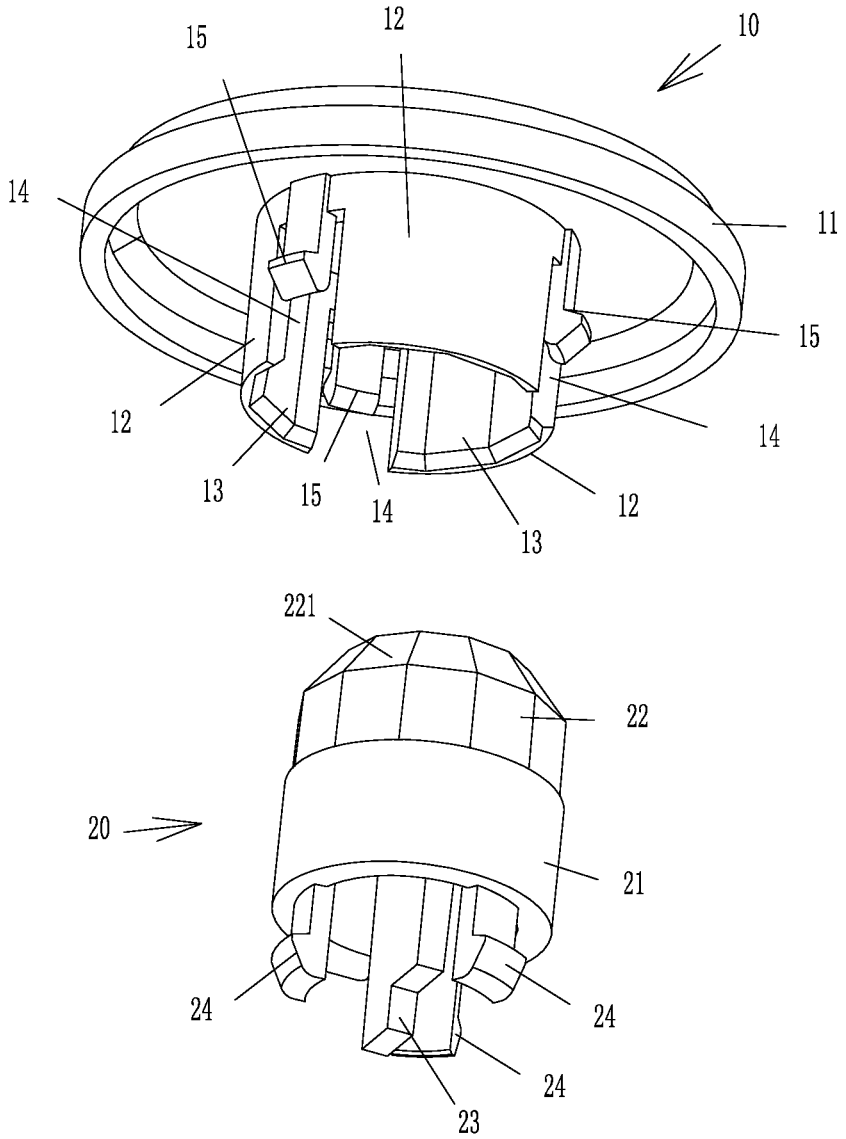
FIG. 2 illustrates the foldable structure of the thermoregulator knob of the FIG. 1.

The structure of the thermoregulator knob in break state of the embodiment is figured in the FIG. 2. The thermoregulator knob is consisting of the external knob 10 and the inner knob 20.

Figure 3:
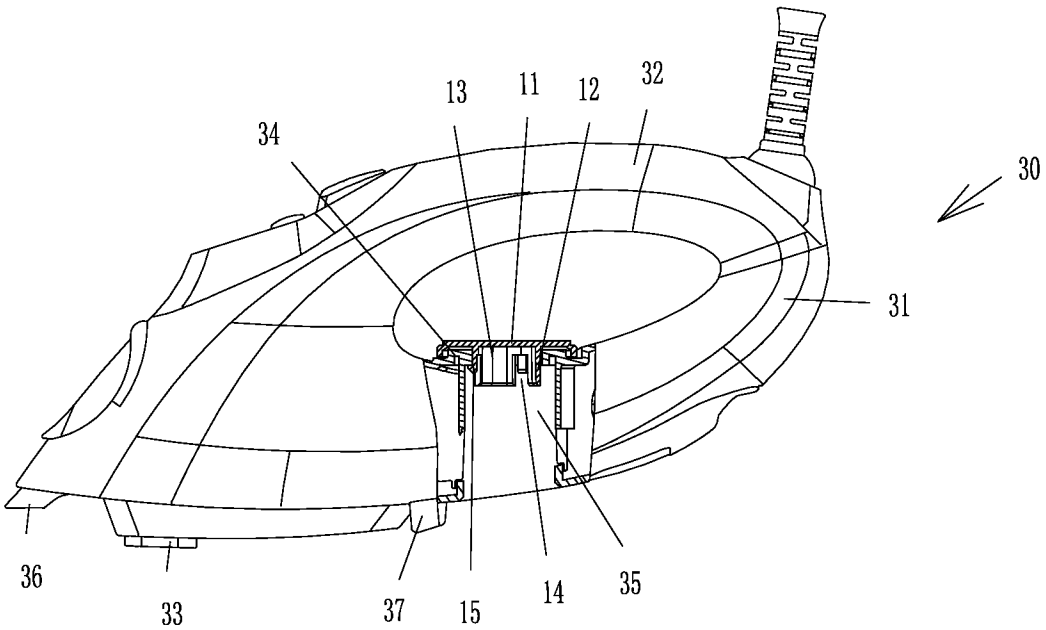
FIG. 3 illustrates the partial section view of the external knob installing into the steam brush set of the FIG. 1.

Please refer to the FIG. 3 with combination with the FIG. 2: the external knob is made of transparent material. The upper portion of the external knob 10 is a disc 11 with the opening downward. A circle boss is extended upwards from the central portion of the upper surface of the disc 11. A circle pipe shaped axle sleeve 12 is extended downward from the central portion of the lower surface of the disc 11. The inner wall 13 of the axle sleeve 12 is cut into an interior cylinder of polygon with 12 sides of slightly inside shrink. The lower portion of the axle sleeve 12 is cut into three grooves of evenly distribution. The root of the every groove 14 is extending downward with a lock catch 15 of the catch head turning inside out. The distance between the root of the catch head of the three lock catch 15 and the lower edge of the disc 11 is slightly bigger than the wall thickness of the inner flange on the top of the assembly portion 34 of the steam brush set 30. The length of every lock catch 15 is bigger than that of the axle sleeve 12 to make sure that the depth of the inner wall 13 of the axle sleeve 12 is big enough to accommodate the rod like insert portion 22 of the inner knob 20.

The external knob 10 is inserted into the assembly portion 34 on the housing 31 of the steam brush set 30. The disc 11 in the upper portion of the external knob 10 is disposed above the assembly portion 34. The axle sleeve 12 and the three lock catches 15 are dipped into the pipe hole 35 inside the assembly portion 34. The catch head of the three lock catches 15 are locked in the inner flange at the upper portion of the assembly portion 34. The upper surface of the inner flange at the upper portion of the assembly portion 34 is printed with level scale of the thermoregulator. The level scale can be read clearly through the disc 11 of the external knob 10.

Figure 4:
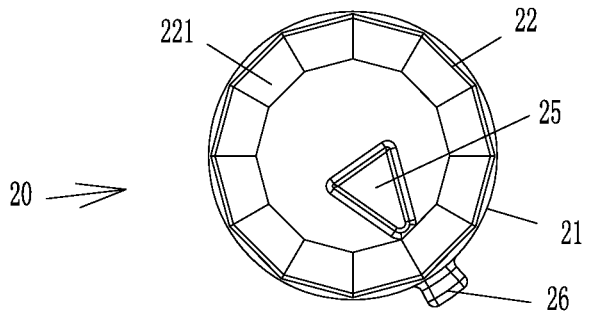
FIG. 4 illustrates top view of the inner knob of the FIG. 1.
Figure 5:
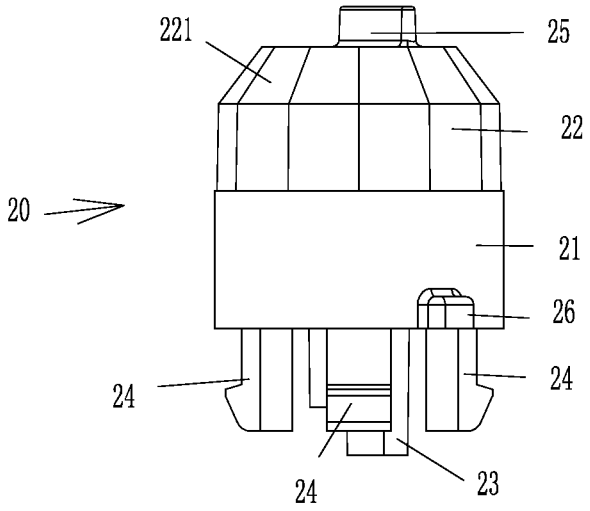
FIG. 5 illustrates the side view of the inner knob of the FIG. 1.
Figure 6:
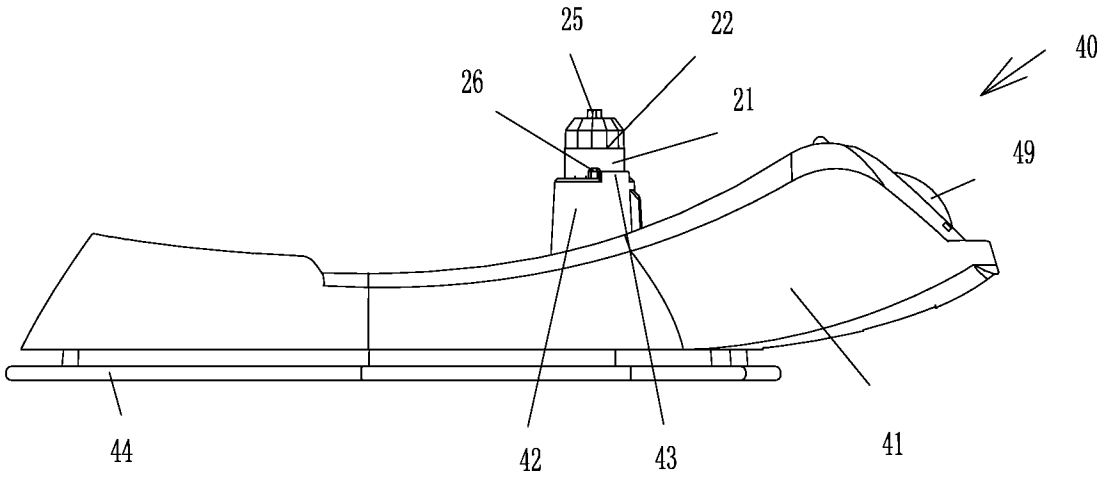
FIG. 6 illustrates the side view of the inner knob installing to the base set of the FIG. 1.

Please refer to the FIG. 4 and FIG. 5 with combination with the FIG. 2: the central of the inner knob is a circle pipe shaped body 21. The upper surface of the body 21 is extended upward with a rod like insert portion 22 of polygon with 12 sides of slightly inside shrink. The size of the insert portion 22 is corresponding to the inner wall 13 of the axle sleeve 12 of the external knob 10 in inserted way. The central of the lower surface inside the body is extended downward with an elongated lifting lever 23. The lower portion of the lifting lever 23 is cut with a gap for orientation marker. The lower portion outside the body 21 is extended downward evenly with three lock catches 24 of the catch head turning inside out. The lower of each lock catch 24 are higher than the lower of the lifting lever 23. The upper of the insert portion 22 is a frustum 221 of polygon with 12 sides of slightly inside shrink. The upper surface of the frustum is disposed with a raised arrowhead 25. The upper surface of the arrowhead 25 is painted a bright color to mark the orientation of the gap of the lifting lever 23. A limited block 26 of projected outward, corresponding to the arrowhead 25, is disposed in the lower of the periphery of the body 21.

Please refer to the FIG. 6, FIG. 7, FIG. 8 and FIG. 10: the inner knob 20 is locked into the circle pipe shaped boss 42 on the housing 41 of the base set 40. The body 21 of the inner knob 20 is above the boss 42. The lifting lever 23 and the three lock catches are plugged into the pipe hole of the boss 42. The catch head of each lock catch 24 is locked in the inner flange in the upper of the boss 42. The lifting lever 23 is inserted into the groove in the upper of the thermoregulator base 45. The gap in the lower of the lifting lever 23 is locked in the raise inside the groove of the thermoregulator base 45 to make the orientation of the lifting lever 23 is corresponding to the orientation of the level lever 46 of the thermoregulator, making sure the arrowhead 25 on the inner knob 20 is uniquely indicated the level of the thermoregulator. The limited block 26 of the inner knob 20 is cooperated with the cog 43 on the upper surface of the boss 42 to limit the rotation range of the inner knob, that is the limited of the level lever 46 rotating within the specified level position.

Figure 9:
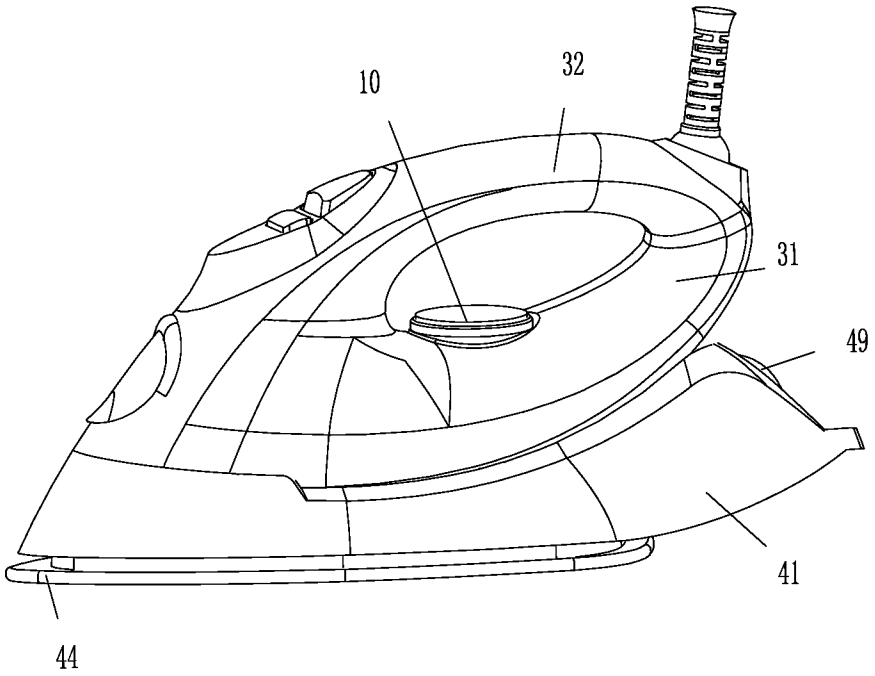
FIG. 9 illustrates the assembled structure of the FIG. 1.
Figure 10:
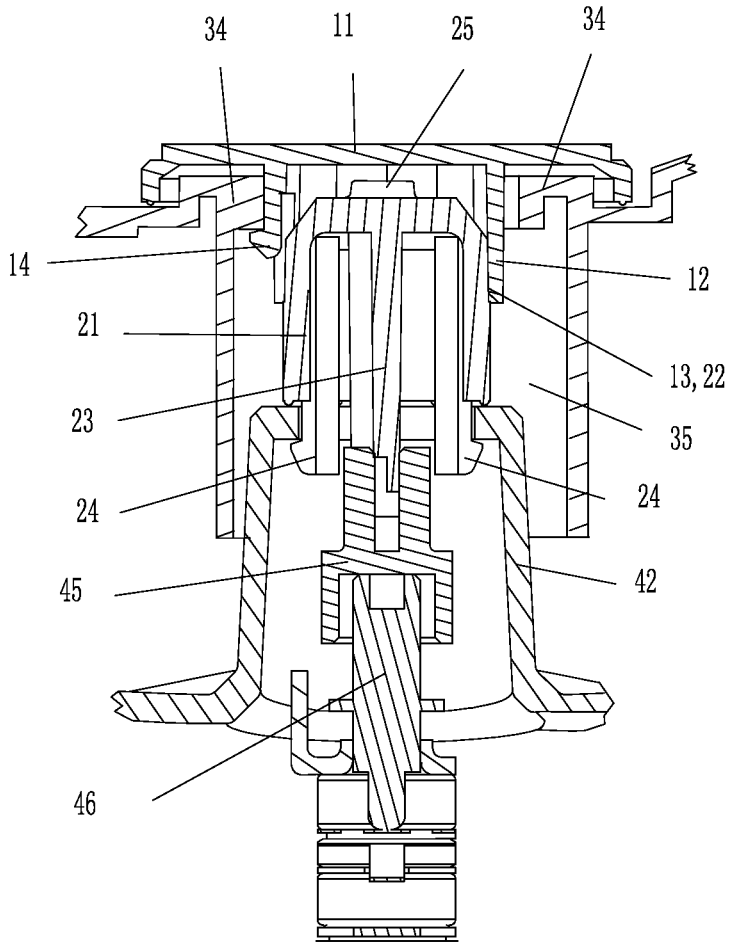
FIG. 10 illustrates the sectional view of the thermoregulator knob in the FIG. 1.

Please refer to the FIG. 9 and the FIG. 10: the steam brush set 30 is locked on the base set 40, forming an iron with handle. The insert portion 22 of the inner knob 20 is inserted in the inner wall 13 of the axle sleeve of the external knob 10. When rotating the disc 11 of the external knob 10, the inner knob 20, the thermoregulator base 45 and the level lever 46 of the thermoregulator are rotated synchronously. The arrowhead 25 on the inner knob 20 and the present level of the thermoregulator corresponding with the level scale on the housing 31 of the steam brush set 30 are read clearly through the disc 11 of the external knob 10.

The Second Embodiment

Figure 11:
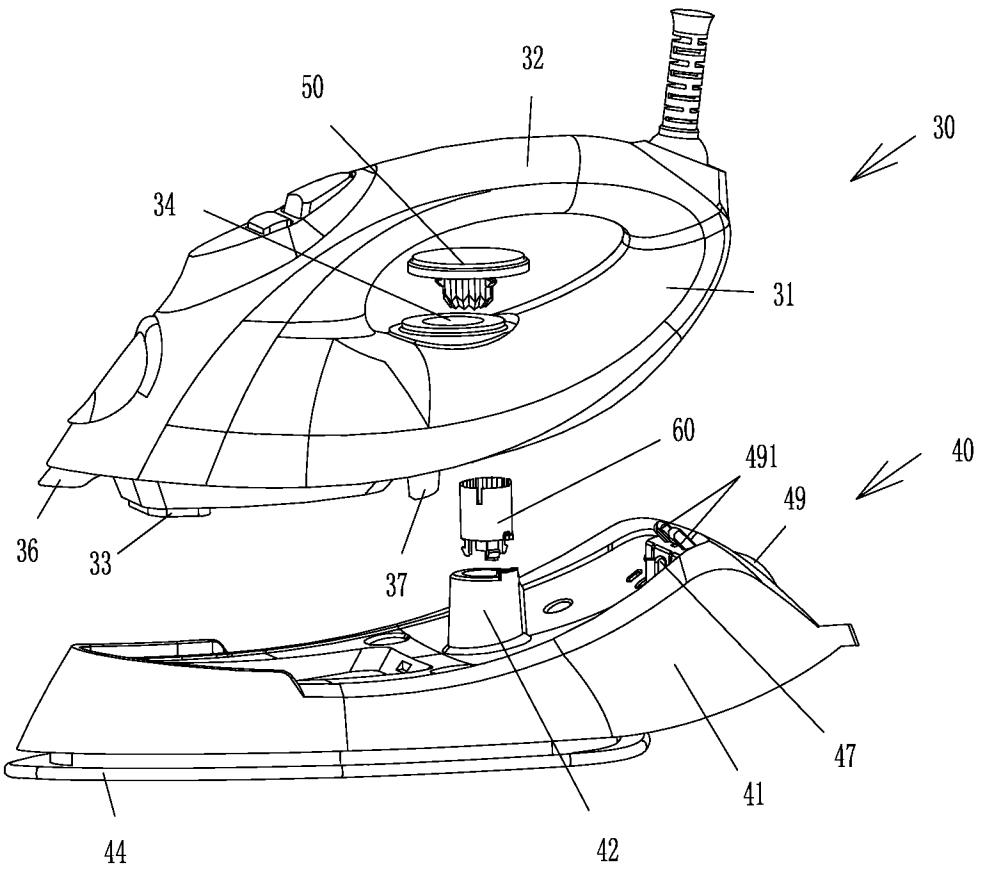
FIG. 11 illustrates the foldable structure of the second embodiment of the is biservice iron in the present invention.

The structure of the second embodiment of a biservice iron in break state is figured in the FIG. 11. The biservice iron same as the prefer embodiment includes an independent steam brush set 30 and an independent base set 40.

A handle 32 is disposed on the housing 31 of the steam brush 30 for garment steaming. A steam boiler of electric heated is disposed inside the housing 31 of the steam brush set 30. The steam outlet pipe of the steam boiler is connected to outside from the steam outlet portion 33 on the bottom of the housing 31. The electric wire is led into the housing 31 from the rear portion and connected to the switch of the steam boiler. When turning on the switch, the steam boiler is energized by the external power. The water inside the steam boiler turns into steam and spurts out from the steam outlet portion 33 on the bottom of the housing 31. An assembly portion 34 of circuit pipe shaped is disposed below the handle 32 on the housing 31 of the steam brush set 30 for the assembly of the external knob 10. The front portion of the housing 31 of the steam brush set 30 is extended down with an insert head 36. The two sides of the central portion of the housing 31 of the steam brush set 30 are extended down with an insert head 37 each. A catch groove is disposed at the rear of the housing 31 of the steam brush set 30 for holding the overturn catch head 491. The rear portion on the lower surface of the housing 31 of the steam brush set 30 is disposed with an electrical outlet for energizing the base set 40.

The housing 41 of the base set 40 is disposed without a handle. The central of the housing 41 of the base set 40 is disposed with a concave accommodation room 48 to accommodate and catch the lower portion of the steam brush set 30. The central of the accommodation room 48 is disposed with a circular pipe shaped boss 42 extending upward. The upper surface of the boss is disposed with an upward cog 43. The heating pan 44 is disposed on the bottom of the housing 41 of the base set 40. A thermoregulator is disposed inside the housing 41 to energize the heating pan 44 and then change the heat radiation of the heating pan 44. The level lever 46 of the thermoregulator is disposed inside the boss 42 to rotatably connect to the inner knob 20. The rear portion of the accommodation room 48 is disposed with an electrical plug 47, which is cooperated with the electrical outlet of the housing 31 of the steam brush set 30 to receive the power from the steam brush set 30 and then energize the thermoregulator. The rear portion of the accommodation room 48 is disposed with an overturn catch head 491, which is controlled by the lock knob 49 at the rear of the housing 41 of the base set 40.

Put the steam brush set 30 on the accommodation room 48 of the housing 41 of the base set 40, the insert head 36 in the front of the housing 31 of the steam brush set 30 and the insert heads 37 on the two sides of the central of the housing 31 of the steam brush set 30 are separately withstanding the inner wall of the front and the two sides of the central portion of the accommodation room 48. The electrical outlet on the lower surface of the housing 31 of the steam brush set 30 is cooperated with the electrical plug 47 at the rear portion of the accommodation room 48. Rotate the lock knob 49, making the overturn catch head 491 locked into the catch groove at the rear portion of the housing 31 of the steam brush set 30, and then the steam brush set 30 is locked to the base set 40, forming an iron with handle for ironing.

Figure 12:
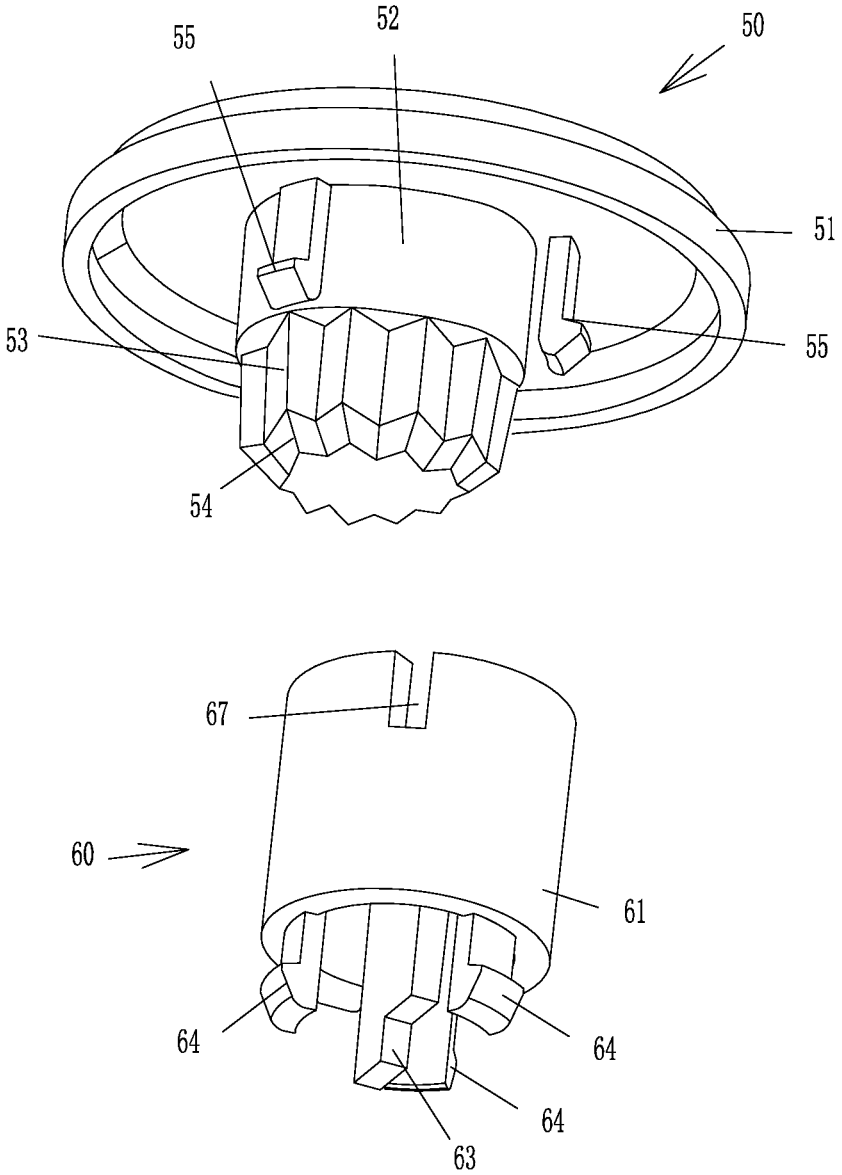
FIG. 12 illustrates the foldable structure of the thermoregulator in the FIG. 11.

The structure of the thermoregulator knob in break state of the embodiment is figured in the FIG. 12. The thermoregulator knob is consisting of the external knob 50 and the inner knob 60.

Figure 13:
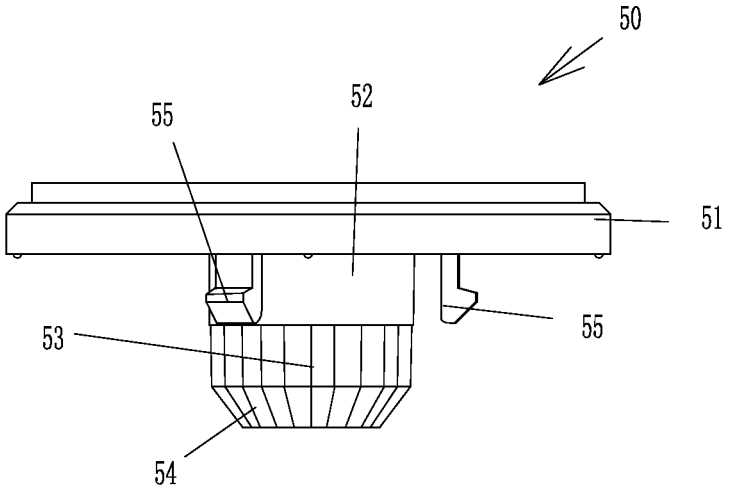
FIG. 13 illustrates the side view of the external knob in the FIG. 11.
Figure 14:
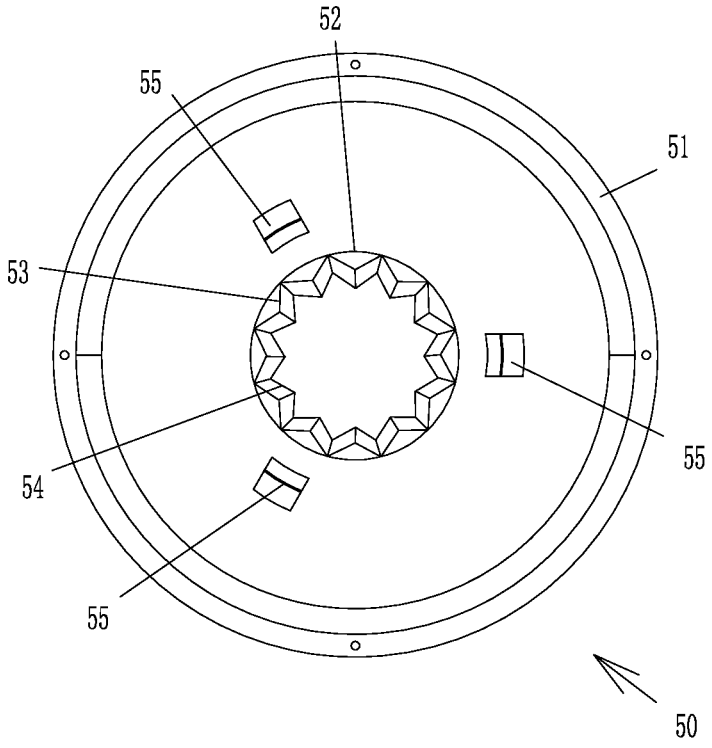
FIG. 14 illustrates the bottom view of the inner knob in the FIG. 11.
Figure 17:
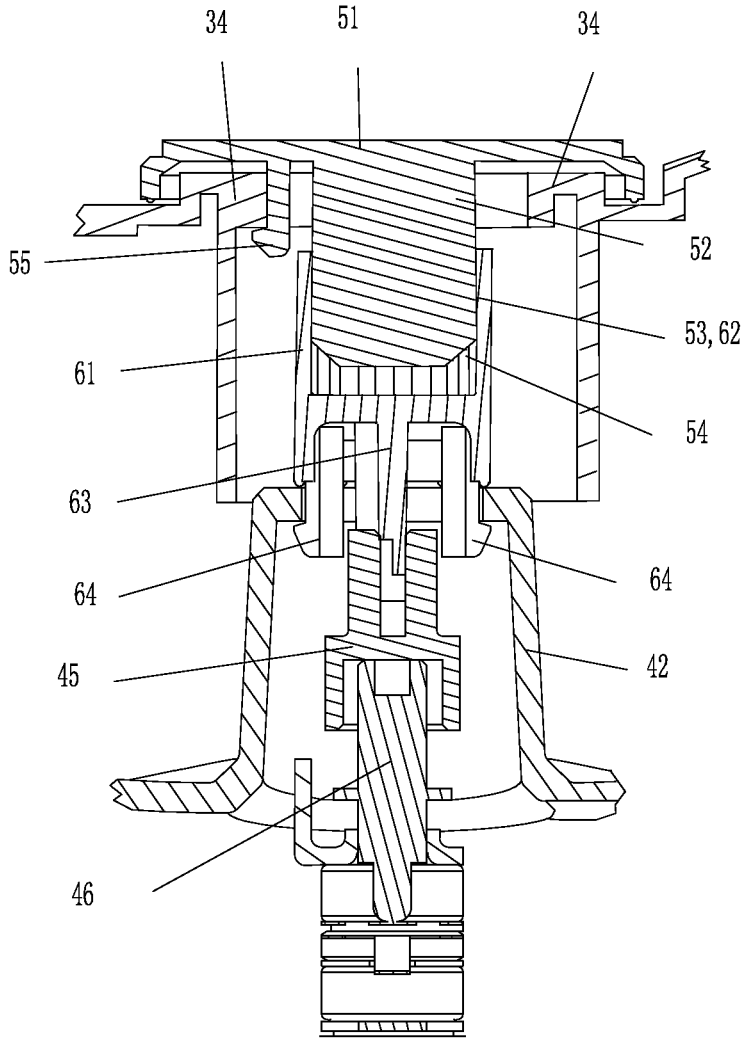
FIG. 17 illustrates the sectional view of the thermoregulator knob of assembled in the FIG. 11.

Please refer to the FIG. 13, FIG. 14 and FIG. 17 with combination with the FIG. 12: The upper portion of the external knob 50 is a disc 51 with the opening downward. A circle boss is extended upwards from the central portion of the upper surface of the disc 51. A circle short axis 52 is extended downward from the central of the lower surface of the disc 51. The lower of the short axis 52 is an external cylinder 53 of polygon with 12 eaves. The external cylinder 53 is a conical surface of polygon with 12 eaves of slightly inside shrink. The lower surface of the disc 51 is located outside the short axis 52 and extended downward with three lock catches 55 evenly distributed in the peripheral direction. The catch head of every lock catch 55 is turning inside out. The distance between the root of the catch head of the lock catch 55 and the lower edge of the disc 51 is slightly bigger than the wall thickness of the inner flange of the steam brush set 30 according to the top of the assembly portion 34. The length of every lock catch 55 is less than that of the short axis 52, making sure that the external cylinder 53 of the short axis 52 is deep enough to insert into the insert hole 62 of the inner knob 50.

The external knob 50 is inserted into the assembly portion 34 on the housing 31 of the steam brush set 30. The disc 51 in the upper portion of the external knob 50 is disposed above the assembly portion 34. The short axis 52 and the three lock catches 55 are dipped into the pipe hole 35 inside the assembly portion 34. The catch head of the three lock catches 55 are locked in the inner flange at the upper portion of the assembly portion 34. The upper surface of the inner flange at the upper portion of the assembly portion 34 is printed with level scale of the thermoregulator. The level scale can be read clearly through the disc 51 of the external knob 50.

Figure 15:
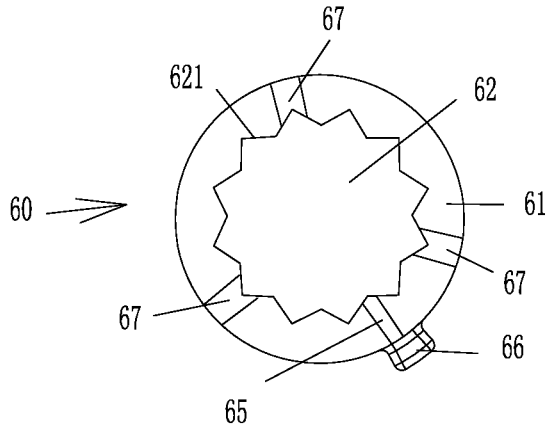
FIG. 15 illustrates the top view of the inner knob in the FIG. 11.
Figure 16:
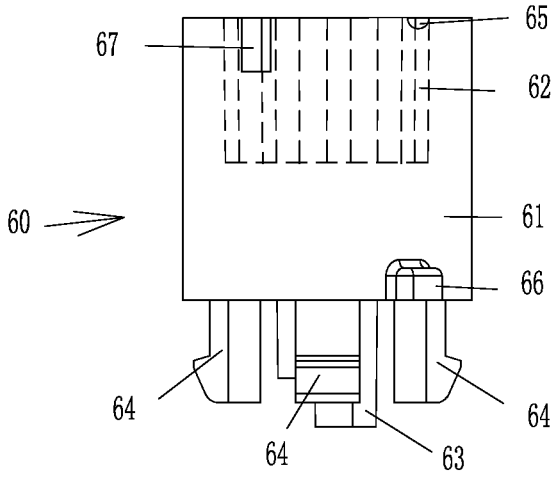
FIG. 16 illustrates the side view of the inner knob in the FIG. 11.

Please refer to the FIG. 15, FIG. 16 and FIG. 17 with combination with the FIG. 12: the central and the upper of the inner knob 60 is a circle pipe shaped body 61, the upper surface of which is extended upward with an insert hole 62 with an interior cylinder of polygon with 12 eaves of slightly inside shrink. The size of the insert hole 62 is corresponding to the external cylinder 53 of the short axis 52 of the external knob 50 in inserted way. The central of the lower surface inside the body 61 is extended downward with an elongated lifting lever 63. The lower portion of the lifting lever 63 is cut with a gap for orientation marker. The lower portion outside the body 61 is extended downward evenly with three lock catches 64 of the catch head turning inside out. The lower of each lock catch 64 is higher than the lower of the lifting lever 63. The upper surface of the body 61 is disposed with a concave radial scratch 65 and three grooves 67 of evenly distribution in the periphery direction. The upper surface of the scratch 65 is painted a bright color to mark the orientation of the gap of the lifting lever 23. A limited block 66 of projected outward, corresponding to the scratch 65, is disposed in the lower of the periphery of the body 61.

The inner knob 60 is locked into the circle pipe shaped boss 42 on the housing 41 of the base set 40. The body 61 of the inner knob 60 is above the boss 42. The lifting lever 23 and the three lock catches 64 are plugged into the pipe hole of the boss 42. The catch head of each lock catch 64 is locked in the inner flange in the upper of the boss 42. The lifting lever 63 is inserted into the groove in the upper of the thermoregulator base 45. The gap in the lower of the lifting lever 63 is locked in the raise inside the groove of the thermoregulator base 45 to make the orientation of the lifting lever 63 is corresponding to the orientation of the level lever 46 of the thermoregulator, making sure that the scratch 65 on the inner knob 60 is uniquely indicated the level of the thermoregulator. The limited block 66 of the inner knob 60 is cooperated with the cog 43 on the upper surface of the boss 42 to limit the rotation range of the inner knob. That is the limited of the level lever 46 rotating within the specified level position.

The steam brush set 30 is locked on the base set 40, forming an iron with handle. The external cylinder 53 of polygon with 12 eaves of the short axis 52 of the external knob 50 is inserted into the insert hole 62 of the inner knob 60. When rotating the disc 51 of the external knob 50, the inner knob 60, the thermoregulator base 45 and the level lever 46 of the thermoregulator are rotated synchronously. The scratch 65 on the inner knob 60 and the present level of the thermoregulator corresponding with the level scale on the housing 31 of the steam brush set 30 are read clearly through the disc 61 of the inner knob 60.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

INDUSTRIAL APPLICABILITY

The present invention is provided with a biservice iron, in which the steam brush set and the base set are assemble or disassemble. The independent steam brush set is used for garment ironing or for providing hot steam. The steam brush set and the base set is assembled to be an iron. The present invention expands the usage mode of the iron.

What is claimed is:

1. An iron comprising a combination including a steam brush set and a base set, the steam brush set configured to operate independently as a steam brush, having a steam brush housing and an external knob rotatably disposed on the steam brush housing, the external knob having one of a protrusion member and a cylindrical socket, the protrusion member and the cylindrical socket rotatably engaged; and the base set having a base set housing, an accommodation room for receiving the steam brush set, a thermoregulator having a level lever, a heating pan, and an inner knob rotatably disposed on the base set housing, the inner knob having one of the other of the protrusion member and the cylindrical socket;

wherein upon assembly of the combination, the accommodation room of the base set receives the steam brush set, the cylindrical socket slidably engages the protrusion member so that the external knob on the steam brush set is coupled to the level lever for setting the thermoregulator on the base set; and the combination is capable of operating as an iron, and wherein the protrusion member has extensions forming an equilateral polygon shape, and the cylindrical socket has a cavity shaped to fittingly receive the protrusion member and to synchronously rotate therewith.

2. The iron according to claim 1, wherein the level lever further comprises a thermoregulator base having a groove, the inner knob further comprises a lifting lever, and the lifting lever is inserted into the groove of the thermoregulator base.

3. The iron according to claim 1, wherein the protrusion member's extensions form a star-shaped equilateral polygon.

4. The iron according to claim 1, wherein the protrusion member forms an equilateral polygon-shaped member having a convex polygon shape.

5. The iron according to claim 4, wherein protrusion member having the convex-polygon shape has at least eight edges.

6. The iron according to claim 1, wherein the inner knob is perpendicular to the heating pan.

7. The iron according to claim 1, wherein the protrusion member has a conical end.

8. The iron according to claim 1, wherein the cylindrical socket has an end, at least two grooves at the end for providing an elastic restoring force, and when the protrusion member is inserted into the cylindrical socket, the elastic restoring force adjusts an alignment of the protrusion member and the cylindrical socket.

9. The iron according to claim 1, wherein: the external knob further comprises:

a disc having a lower surface and a center region on the lower surface, at least three lock catches extending from a periphery of the center region; each of the lock catches having a catch head;

the base set further comprises:

an assembly portion in the base set housing, the assembly portion defining a pipe hole with an inner flange; and the catch heads lock onto the inner flange.

10. The iron according to claim 9, wherein the at least three lock catches of the disc are evenly distributed.

11. The iron according to claim 1, wherein the external knob is transparent, and an upper surface of the inner knob has a marker for indicating a position of the level lever of the thermoregulator.

12. The iron according to claim 1, wherein the inner knob has a circle pipe shaped body, at least three lock catches extending from a periphery of the center region; each of the lock catches having a catch head;

the accommodation room has a center, a circular pipe shaped boss extends from the center to define an inner flange at an upper end; and the catch heads lock onto the inner flange.

13. The iron according to claim 12, wherein the at least three lock catches of the inner knob are evenly distributed.

* * * * *